United States Patent [19]

Chukhanov et al.

[11] 4,366,043

[45] Dec. 28, 1982

[54] METHOD AND APPARATUS FOR HEAT PROCESSING PULVERIZED BROWN COAL

[76] Inventors: Zinovy F. Chukhanov, ulitsa D. Ulyanova, 3, kv. 40; Zinovy Z. Chukhanov, ulitsa Obrucheva, 6, kv. 352; Sergei A. Tsuprov, B. Vuzovsky pereulok, 1, kv. 26; Ivan V. Lyashenko, Lesnaya ulitsa, 45, kv. 89; Danil M. Apter, ulitsa Gorkogo, 46/7, kv. 13; Anatoly M. Nikolaev, ulitsa Scherbakovskaya, 5, kv. 76; Vadim A. Karasev, Leninsky prospekt, 16, kv. 30, all of Moscow, U.S.S.R.

[21] Appl. No.: 930,198

[22] Filed: Aug. 2, 1978

[51] Int. Cl.[3] ..... C10G 1/00

[52] U.S. Cl. ..... 208/8 R; 201/44

[58] Field of Search ..... 208/8 R; 201/44

[56] References Cited

U.S. PATENT DOCUMENTS

| | | | |
|---|---|---|---|
| 1,954,096 | 4/1934 | Pier et al. | 208/8 R |
| 2,055,029 | 9/1936 | Henny | 208/8 R |
| 2,448,223 | 8/1948 | Lantz | 208/8 R X |
| 2,582,712 | 1/1952 | Howard | 208/8 R |
| 2,654,698 | 10/1953 | Phenney | 208/8 R |

FOREIGN PATENT DOCUMENTS

| | | | |
|---|---|---|---|
| 536190 | 10/1931 | Fed. Rep. of Germany | 208/8 R |
| 1809874 | 6/1970 | Fed. Rep. of Germany | 208/8 R |

*Primary Examiner*—Delbert E. Gantz
*Assistant Examiner*—William G. Wright
*Attorney, Agent, or Firm*—Steinberg & Raskin

[57] ABSTRACT

Heat processing of pulverized brown coal is carried out in two stages. In a chamber for the first-stage heating, brown coal to be processed is heated to a temperature of thermal decomposition thereof with the formation of a solid matter and a vapor and gas mixture. The resultant vapor and gas mixture is removed for purification and condensed to obtain gaseous and liquid products. In a chamber for the second-stage heating, brown coal, in the form of solid matter, is heated to cause additional decomposition thereof, which results in the formation of a solid product and a vapor and gas mixture. The resultant vapor and gas mixture, together with a part of the resultant solid product, is fed through a return conduit into the chamber for the first-stage heating of the brown coal. To develop a draught which causes the solid product particles to move along the return conduit, the latter is provided with a means for feeding a gaseous heat carrier.

1 Claim, 1 Drawing Figure

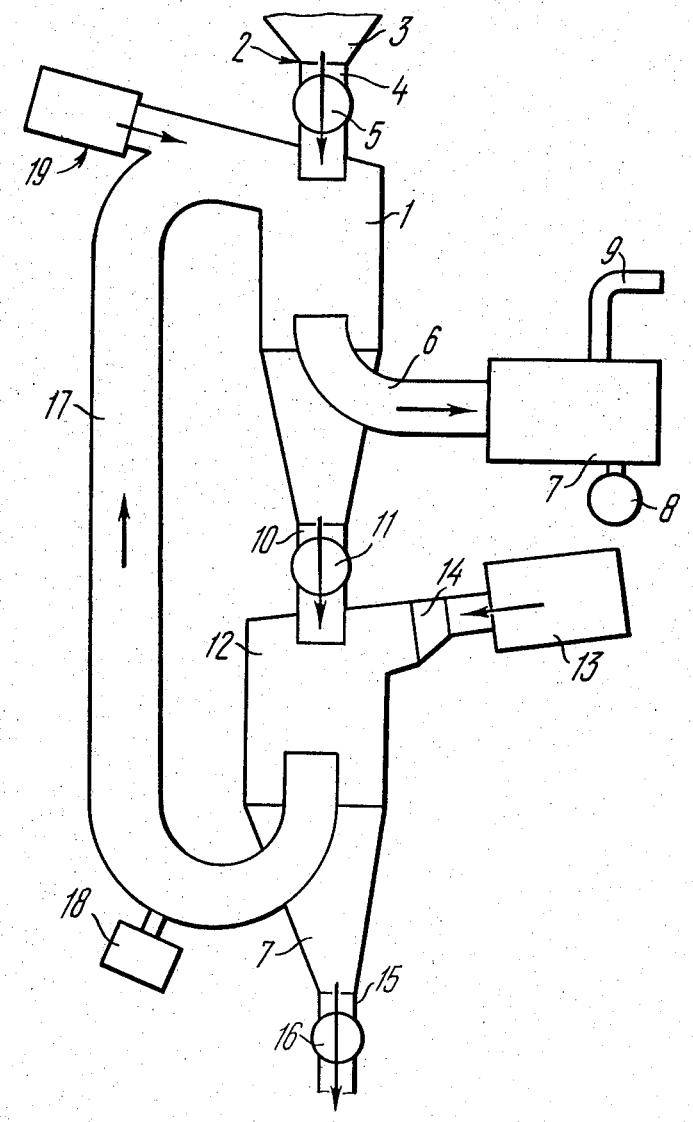
2
3
4
5
19
1
9
6
17
7
8
10
11
14
12
13
18
7
15
16

METHOD AND APPARATUS FOR HEAT PROCESSING PULVERIZED BROWN COAL

The invention relates to methods or the destructive processing of solid carbon-containing materials, and more specifically, to methods and apparatus for heat processing of pulverized brown coal.

The invention is particularly suited for use in power and chemical industries for a combined production, both of highly calorific solid and synthetic liquid fuels, and of other gaseous and liquid products to be subsequently converted into commercial raw materials.

BACKGROUND OF THE INVENTION

With the exhaustion of the world's power resources, the necessity to utilize low-grade solid fuels becomes more and more urgent. Most efficient use of such fuels can be achieved after the same have been converted through heat processing into high-calorific solid and liquid products. Capital and operating expenses and power consumption in processing low-grade fuels are at present rather high. In this connection there is an urgent need to raise the yield of high-quality products produced by heat processing of solid fuels without increasing said expenses. Thus, methods based on slow heating of pulverized fuels being processed were at one time replaced by methods of heat processing of solid fuels involving heating such fuels in less than 1 second to a temperature of their intensive thermal decomposition. Such methods of rapid heating of fuel bring about an increased yield of both solid and liquid products. However, these methods have a disadvantage residing in overheating small particles of the fuel being pyrolyzed, which is caused by a great difference in the temperature between the gaseous heat carrier and the coal being processed. It is known that overheating of the coal particles results in a decreased yield of useful vapour and gas products. In addition, the consumption of the gaseous heat carrier for heating and pyrolysis of brown coal is rather high, and the efficiency of the process is further reduced through the non-utilization of the physical heat of the gas and vapour mixture exiting from the fuel pyrolysis chamber.

A method of and apparatus for heating processing of pulverized brown coal are disclosed in USSR Inventor's Certificate No. 372.244. Said method includes the following steps: a first stage of heating brown coal by a gaseous heat carrier in less than 1 second to a temperature of 500°-800° C., at which terminal decomposition of the brown coal takes place with the formation of a vapour and gas suspension comprising solid pulverized matter and a vapour and gas mixture, the resultant vapour and gas mixture being removed to be purified and condensed to produce gas and liquid products; a second stage of heating of the brown coal in the form of solid matter by a gaseous heat carrier to a temperature of 600°-900° C. at which complete thermal decomposition of the brown coal takes place with the formation of a vapour and gas mixture and a solid pulverized product, the resultant vapour and gas mixture being delivered back to the first stage of heating, which permits utilizing the heat carrier, already used at the second stage of heating, for preheating the brown coal particles without their being overheated. The brown coal to be processed is preheated by a gaseous heat carrier to a temperature of 200°-300° C. prior to its being fed into the chamber for the first-stage heating.

Said apparatus for heat processing pulverized brown coal comprises a chamber of the first-stage heating of the brown coal, said chamber being provided with a means for feeding brown coal therein, a means for feeding a gaseous heat carrier therein and a means for removing therefrom a vapour and gas mixture resulting from the thermal decomposition of the brown coal, a chamber for the second-stage heating of the brown coal to a temperature of complete thermal decomposition thereof, which chamber is successively connected with the chamber for the first-stage heating and is provided with a means for feeding therein a gaseous heat carrier, the chamber for the second-stage heating being connected to the chamber for the first-stage heating by a return conduit for feeding the vapour and gas mixture. In addition, the apparatus incorporates a chamber for preheating the brown coal to a temperature of 200°-300° C. This chamber is arranged before the chamber for the first-stage heating and is successively connected therewith. There is also a chamber for the additional withdrawal of gas which communicates in series with the chamber for the second-stage heating.

Attempts have been made to solve the problem of keeping the small fuel particles, particularly, of brown coal, from overheating and of reducing the heat carrier consumption in the carrying out of the above method and the use of the apparatus. Experience has shown, however, that this is unattainable, since the vapour and gas mixture which is delivered back to the first stage of heating of brown coal, and which is substantially a gaseous heat carrier, cannot provide uniform heating of both large and small particles. When small particles are normally heated, the large ones are heated insufficiently, which does not ensure complete thermal decomposition thereof, and, hence, reduces the yield of gaseous and liquid products. To achieve complete thermal decomposition of large particles, one must raise the temperature of heating of the whole batch of brown coal being processed in the first stage. In this case the overheating of small particles and, hence, increased consumption of the gaseous heat carrier are inevitable. Moreover, an increased proportion of the gaseous heat carrier in the vapour and gas mixture results in worsening of the quality of the resultant gaseous products.

It is an object of the invention to overcome the above disadvantages.

Another object of the invention is the provision of a method of and an apparatus for heat processing of pulverized brown coal which ensure an increased yield of vapour and gas products.

Still another object of the invention is to provide a method of and an apparatus for heat processing of pulverized brown coal which ensure an increased yield of vapour and gas products with the same power consumption as in the prior art method and apparatus for heat processing of pulverized brown coal.

It is a further object of the invention to provide a method of and an apparatus for heat processing of pulverized brown coal which yield gaseous products of a higher quality.

SUMMARY OF THE INVENTION

The foregoing and other objects are attained by a method for heat processing of pulverized brown coal including a first stage of heating of the brown coal by a gaseous heat carrier in less than 1 second to a temperature of 500°-800° C. at which thermal decomposition of the brown coal being processed takes place, to form a solid pulverized matter and a vapour and gas mixture, the resultant vapour and gas mixture being removed to be purified and condensed to produce gas and liquid products, a second stage of heating of the brown coal in the form of solid matter by a gaseous heat carrier to a temperature of 600°–900° C., at which complete thermal decomposition of the brown coal being processed takes place, to form a vapour and gas mixture and a solid product, the resultant vapour and gas mixture being delivered from the second stage back to the first stage of heating, according to the invention said vapour and gas mixture being delivered from the second stage back to the first stage of heating together with a part of the resultant solid product, said vapour and gas mixture and said part of the solid product being additionally heated on the way to the first stage of heating.

The foregoing and other objects are also attained by an apparatus for heat processing of pulverized brown coal comprising a chamber for the first stage heating of the brown coal provided with a means for feeding the brown coal therein and with a means for removing therefrom a vapour and gas mixture resulting from thermal decomposition of the brown coal, a chamber for the second-stage heating of the brown coal being processed, which is successively connected with the chamber for the first-stage heating of the brown coal and which is provided with a means for feeding therein a gaseous heat carrier, and a return conduit connecting the chamber for the second-stage heating with the chamber for the first-stage heating to feed therein the vapour and gas mixture for heating the brown coal being processed, according to the invention the return conduit is provided with a means for feeding the gaseous heat carrier and for additionally heating the vapour and gas mixture and a part of the solid product, the chamber for the first-stage heating being provided with a means for removing therefrom the resultant solid product and for controlling the amount thereof to be fed into the chamber the first-stage heating.

The proposed method and apparatus for heat processing pulverized solid fuel provide a uniform and gradual heating which prevents overheating of the fuel particles. This is achieved due to the fact that the heat carrier which is delivered to the first stage heating from the second stage heating comprises particles of the solid product, which particles, being heat accumulators, gradually and uniformly transmit their heat both to small and large particles of the solid fuel being processed. This in turn ensures complete thermal decomposition of the whole solid product and, hence, an increased yield of gaseous and liquid products. Besides, since a part of the gaseous heat carrier is replaced by a solid heat carrier, and the steam and gas mixture contains a lesser proportion of the gaseous heat carrier, the quality of the resulting gaseous products is improved.

BRIEF DESCRIPTION OF THE DRAWINGS

The foregoing and other objects of the invention will become more apparent from a consideration of a detailed description of an embodiment of the invention in conjunction with the accompanying drawing which shows a diagrammatic view of an apparatus for heating processing of pulverized brown coal.

DESCRIPTION OF THE PREFERRED EMBODIMENT OF THE INVENTION

There is proposed a method for heat processing of pulverized brown coal, which is practised in the following manner.

Brown coal, crushed to particles having a size less than 1 mm, is preheated to a temperature of about 110° C. for drying purposes.

The pulverized brown coal prepared in this way is fed to the first heating stage. In the first stage, the brown coal is heated by a heat carrier, which practically does not contain free oxygen, to a temperature of 500°–800° C. in less than 1 second. This results in thermal decomposition of the brown coal into solid pulverized matter and a vapour and gas mixture. The resultant vapour and gas mixture is removed to be purified and condensed to obtain gaseous and liquid products in a manner known in the art. Simultaneously, the pulverized solid matter is fed to the second stage of heating. In the second stage, the brown coal in the form of solid pulverized matter is heated by a gaseous heat carrier containing no free oxygen, in less than one second, to a temperature of 600°–900° C. This causes additional thermal decomposition of the brown coal being processed to form a solid pulverized product and a vapour and gas mixture. According to the invention, a part of the resultant pulverized solid product is separated from the bulk thereof. The withdrawn part of the solid product together with the vapour and gas mixture is delivered from the second stage of heating to the first stage of heating. To cause the solid product particles to move, the mixed heat carrier resulting from mixing a part of the solid product with the vapour and gas mixture is heated by a gaseous heat carrier in two stages. At first the mixed heat carrier is heated to a temperature of about 900° C. when being withdrawn from the second stage of heating, and then to a temperature of about 1000° C. when entering the first stage of heating.

Having entered the first stage of heating of the brown coal, the mixed heat carrier heats the latter to a temperature of 500°–800° C. Since solid particles of the heat carrier are heat accumulators, they transmit their heat gradually and uniformly both to small and large brown coal particles, which ensures uniform and optimum heating of the entire bulk of the brown coal being processed. As a result, thermal decomposition of the brown coal being processed gives an increased yield of gaseous and liquid products. In addition, since at the second stage the brown coal is heated to a temperature of about 900° C., which is much lower than that in the prior art method (1600° C.), a lesser amount of combustible matter is needed to form a heat carrier.

An apparatus for practising the method of heat processing of pulverized brown coal comprises a cyclone-type chamber 1 for the first-stage heating of the brown coal. The chamber 1 for the first-stage heating is provided with a means 2 for feeding therein pulverized brown coal to be processed. The means 2 incorporates a hopper 3 for brown coal to be processed communicating through a conduit 4 with the chamber 1. A turnstile-type feeder 5 is positioned within the conduit 4. Generally mounted within the chamber 1 is a connection pipe 6 through a bent end of which said chamber 1 communicates with a means 7 for removing a vapour and gas mixture. The means 7 is formed as a cyclone intended for separating solid particles, or brown coal which was carried away, from the vapour and gas mixture. A turnstile-type discharging device 8 is provided for discharging the brown coal which was carried away, and a conduit 9 for removing the vapour and gas mixture. The lower portion of the chamber 1 is provided with a connection pipe 10 which incorporates a turnstile-type feeder II. The chamber 1 for the first-stage heating communicates with a chamber 12 for the second-stage heating of the brown coal by means of the connection pipe 10. Means 13 for forming and feeding a gaseous heat carrier tangentially adjoins the upper portion of the chamber 12. The means 13 incorporates a connection pipe 14 which tangentially adjoins the chamber 12. Centrally mounted within the connection pipe 14 is a burner (not shown) connected to a combustible matter source (not shown). The burner is intended for burning the combustible matter for producing a gaseous heat carrier in the form of fumes which are practically free of air oxygen. To remove the resultant solid product, the chamber 12 incorporates a connection pipe 15 mounted in the lower portion of this chamber and provided with a turnstile-type feed control device 16.

The chamber 12 for the second-stage heating communicates with the chamber 1 for the first-stage heating through a return conduit 17, the upper end of the conduit 17 tangentially adjoining the chamber 1. Mounted within the conduit 17 is a means 18 for feeding a gaseous heat carrier, incorporating a burner (not shown) for burning a combustible matter to produce a gaseous heat carrier in the form of fumes. When it is necessary to raise the temperature of the heat carrier being fed into the chamber 1, means 19 for burning gas and feeding the heat carrier may be mounted at the end of the conduit 17 adjoining the chamber 1.

The apparatus for heat processing of pulverized brown coal operates in the following manner.

Brown coal crushed to the particle size below 1 mm and preheated to a temperature of about 110° C. for drying is continuously fed through the feeder 5 from the hopper 3 into the chamber 1 for the first-stage heating. Simultaneously a heat carrier in the form of a vapour and gas mixture comprising particles of a solid product, resulting from the heat processing of brown coal at the second stage of heating, is delivered from the chamber 12 through the return conduit 17 into the chamber 1. Under the action of centrifugal forces the brown coal particles entrained by a swirling flow of the heat carrier are thrown from the central portion of the chamber 1 towards its walls, traversing the mixed heat carrier. The brown coal is heated with a high heat-exchange coefficient. Heating of the brown coal to a temperature of 500°–800° C. causes thermal decomposition thereof, the result being a solid pulverized matter and a vapour and gas mixture. The resultant vapour and gas mixture is removed through the connection pipe 6 into the means 7 to be purified from solid particles. The purified vapour and gas mixture is withdrawn through the conduit 9 for condensation with a view to producing liquid and gaseous products in a conventional manner. Solid matter trapped by the cyclone 7 is discharged therefrom by the turnstile-type discharging device 8.

From the chamber 1 the brown coal being processed is delivered by the turnstile-type feeder 11 into the chamber 12 for the second-stage heating. Simultaneously a gaseous heat carrier in the form of fumes resulting from the burning of a combustible gas is tangentially fed into the chamber 12 through the connection pipe 14. Particles of the brown coal being processed are entrained by a swirling flow of the gaseous heat carrier and under the action of centrifugal forces thrown from the central portion of the chamber 12 towards the walls thereof, traversing the heat carrier flow. There takes a place additional heating of large particles of the brown coal being processed to a temperature of 600°–900° C. This results in thermal decomposition of the large particles which have not been completely decomposed in the chamber 1 for the first-stage heating of the brown coal. The turnstile-type feed control device 16 discharges a major portion of the resultant solid product.

The other portion of the solid product is delivered together with the vapour and gas mixture from the chamber 12 through the return conduit 17 into the chamber 1 for the first-stage heating. The solid particle content in the mixed heat carrier may be controlled by the feed control device 16, i.e. an increase in the amount of the finished solid product discharged therethrough from the chamber 12 decreases the portion of the solid product which enters the return conduit 17 together with the vapour and gas mixture. To cause the mixed heat carrier to move through the return conduit 17, the latter incorporates the means 18 for feeding a gaseous heat carrier in the form of fumes having a temperature of about 900° C. Depending on the kind of brown coal and its physical state, including the size of its particles, there may be a need to raise the temperature of the heat carrier being fed into the first chamber. For this purpose a gaseous heat carrier having a temperature of about 1000° C. is fed into the chamber 1 for the first-stage heating, which provides both an increased temperature of heating of the brown coal being processed and an improved draught for moving the solid product constituting part of the mixed heat carrier.

EXAMPLE

Brown coal having an ash content of 9.6% was crushed to the particle size less than 1 mm and preheated to a temperature of 110° C. for drying.

Having been prepared in this way brown coal was continually fed into the chamber 1 for the first-stage heating, where it was heated in the vortex of a heat carrier which was a vapour and gas mixture including particles of solid product, i.e. it was heated by a mixed heat carrier. The mixed heat carrier was taken from the chamber 12 for the second-stage heating. The heat of the mixed heat carrier was transferred to the brown coal being processed, and, as a result, the latter was heated in less than 1 second to a temperature of 640° C. and decomposed in a solid matter and a vapour and gas mixture. The vapour and gas mixture was withdrawn to be purified and condensed with a view to producing gaseous and liquid products. Simultaneously the brown coal heated to a temperature of 640° C. was continuously fed by the feeder 11 into the chamber 12 for the second-stage heating. In the chamber 12 the brown coal being processed was heated in a vortex of a gaseous heat carrier having a temperature of about 1200° C.

The gaseous heat carrier was fed into the chamber 12 in a ratio of 0.25 $m^3$ per kg of the brown coal being processed. In the chamber 12 the brown coal was heated to a temperature of 750° C., the gaseous heat carrier being cooled in the process to a temperature of 760° C. As a result of heating in less than 1 second in the chamber 12, large particles of brown coal, which did not decompose in the chamber 1 for the first-stage heating, decomposed forming a high-calorific solid product and a vapour and gas mixture which additionally evolved as a volatile matter, mainly $CH_4$ and $H_2$, in a ratio of 15 $m^3$ per ton of the coal being processed, and about 1% of pyrogenic water. The resultant vapour and gas mixture, the spent head carrier and a portion of the resultant solid product were delivered together i.e. as a mixed heat carrier, through the return conduit 17 into the chamber 1 for the first-stage heating. On the way to the chamber 1 the mixed heat carrier was additionally heated by burning a gaseous heat carrier in the means 18 in order to raise the temperature of the mixed heat carrier up to about 870°–980° C. and to develop a draught to cause the solid product particles to move. The mixed heat carrier, entering chamber 1 tangentially for the first-stage heating, entrained particles of the brown coal which was continuously fed into the chamber 1, which particles under the action of centrifugal forces were thrown towards the wall of the chamber 1, traversing the heat carrier flow. The heat of the heat carrier was transferred to the particles of the brown coal which were heated to a temperature of 640° C. As the solid product particles constituting part of the mixed heat carrier were substantially heat accumulators, gradually and uniformly their heat was transferred to small and large particles of the brown coal being processed. As a result uniform thermal decomposition of the brown coal took place, with the formation of a solid matter and a vapour and gas mixture. The resultant vapour and gas mixture was removed to be purified and subsequently condensed to produce gaseous and liquid products in a conventional manner.

The use of the method according to the invention for processing said brown coal made it possible to increase, per ton of the brown coal to be processed, the yield of tar and natural gasoline up to 162 kg as against 120–130 kg resulting from the processing of the same coal by the prior art method, the operating conditions being the same, including the temperature of heating (640° C.). This was attained by lowering the temperature of the heat carrier being fed to the first stage of heating of the brown coal to about 870°–980° C. as against the heat carrier temperature of 1200° C. in the prior art method. As a result, the consumption of combustible matter needed for forming a gaseous heat carrier was reduced, as well as the proportion of fumes in the vapour and gas mixture, while the quality of the vapour and gas products improved.

Thus, practically without increasing power consumption, the proposed method and apparatus make it possible to raise the yield of the vapour and gas products by 25–35%, depending on the type, grade and particle size of the brown coal being processed.

It is obvious that the preferred embodiment of the present invention disclosed hereinabove is merely illustrative and that the invention may be practised otherwise than as specifically described without departing from the scope of the appended claims.

We claim:

1. Method of heat processing pulverized brown coal, which comprises heating said pulverized brown coal in a first stage by a heat carrier which is substantially devoid of free oxygen in less than one second to a temperature of about 500°–800° C. at which thermal decomposition of said brown coal takes place, thus forming a first stage mixture of heated solid particles of brown coal and of a vapor and gas mixture, removing said vapor and gas mixture for further processing to produce gaseous and liquid products, passing said heated solid particles into a second stage, further heating said solid particles of brown coal in said second stage by means of a heat carrier devoid of free oxygen in less than one second to a temperature of about 600°–900° C. to further thermally decompose said brown coal, thereby forming a second stage mixture of heated solid particles of brown coal and a vapour and gas mixture, removing a major portion of said second stage heated solid particles of brown coal, passing the remaining heated solid particles of brown coal and said vapor and gas mixture from said second stage to said first stage while further heating the same during such passage by means of a gaseous heat carrier devoid of free oxygen to a temperature of about 870°–1000° C., thus forming a draught which causes the solid particles to move, said further heated remaining mixture from said second stage acting as heat carrier for said first stage.

* * * * *